US006953422B2

(12) United States Patent
Long et al.

(10) Patent No.: US 6,953,422 B2
(45) Date of Patent: Oct. 11, 2005

(54) SYSTEM AND METHOD FOR REPLACING WEB FOLDING BOARDS

(75) Inventors: Leslie T. Long, Appleton, WI (US); John H. Evans, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/310,697

(22) Filed: Dec. 5, 2002

(65) Prior Publication Data

US 2004/0110622 A1 Jun. 10, 2004

(51) Int. Cl.[7] ..... B31B 1/00

(52) U.S. Cl. ..... 493/478; 493/405; 493/416; 493/451; 493/448

(58) Field of Search ..... 493/405, 416, 493/436, 443, 444, 451, 458, 447, 448, 478

(56) References Cited

U.S. PATENT DOCUMENTS

| | | | |
|---|---|---|---|
| 2,761,676 | A | 9/1956 | Sabee et al. |
| 3,199,861 | A | 8/1965 | Presnell et al. |
| 3,285,599 | A | 11/1966 | Pherson et al. |
| 3,291,479 | A | 12/1966 | Greiner et al. |
| 3,330,553 | A | 7/1967 | Couzens et al. |
| 3,401,927 | A | 9/1968 | Frick et al. |
| 3,472,504 | A | 10/1969 | Murphy et al. |
| 3,513,743 | A | 5/1970 | Montguire |
| 4,052,048 | A | 10/1977 | Shirasaka |
| 4,190,241 | A | 2/1980 | Krueger |
| 4,327,620 | A | 5/1982 | Greinke et al. |
| 4,328,655 | A | 5/1982 | Spencer et al. |
| 4,502,675 | A | 3/1985 | Clark et al. |
| 4,648,861 | A | 3/1987 | Pierce |
| 4,650,530 | A | 3/1987 | Mahoney et al. |
| 4,717,135 | A | 1/1988 | Hathaway |
| 4,747,813 | A | 5/1988 | Genoud et al. |
| 5,421,072 | A | 6/1995 | Kuban |
| 5,690,263 | A | 11/1997 | Abba et al. |
| 5,868,276 | A | 2/1999 | Loppnow et al. |
| 5,992,682 | A | 11/1999 | Loppnow et al. |
| 6,238,328 | B1 | 5/2001 | Loppnow et al. |
| 6,422,552 | B1 | 7/2002 | Chesno et al. |

FOREIGN PATENT DOCUMENTS

| | | |
|---|---|---|
| WO | WO 0212105 A2 | 2/2002 |

*Primary Examiner*—Louis K. Huynh
*Assistant Examiner*—Christopher Hamon
(74) *Attorney, Agent, or Firm*—Dority & Manning, P.A.

(57) ABSTRACT

A system and method for selectively replacing one set of folding boards with another set of folding boards is provided. In one embodiment, a first set and a second set of folding boards are secured to carriage assemblies that are moveable in and out of a web-receiving position. Through the system and method of the present invention, it has been discovered that a set of folding boards may be quickly and efficiently replaced with another set of folding boards.

25 Claims, 5 Drawing Sheets

SYSTEM AND METHOD FOR REPLACING WEB FOLDING BOARDS

BACKGROUND OF THE INVENTION

Various types of products, such as facial tissues, napkins, wipes, etc., are folded and stacked, and then cut to length to store in a container or dispenser. For example, facial tissues are commonly folded in a manner such that a consumer can more easily grasp one or more of the tissues from the box. In the past, webs have been folded using a device known as a folding board. For instance, some examples of such folding boards are described in U.S. Pat. No. 4,052,048 to Shirasaka. A folding board generally receives a web and, based on its design, folds the web into a particular configuration. In certain instances, more than one folding board is utilized to fold multiple webs. For example, during facial tissue converting, a tissue web is continuously unwound from a roll, redirected by a turning bar, folded, and laid down onto previously folded tissue webs to form a continuous stack of tissues. These operations are carried out in a machine known as a multifolder that uses multiple folding boards to fold multiple webs.

One problem currently associated with conventional multifolders, however, is that they typically contain only one set of folding boards. To utilize a set of folders having a different size or configuration, the folding boards must be manually replaced by removing each individual folding board from the line. Unfortunately, manual replacing of folding boards can require a substantial amount of time and energy. Moreover, manual replacing often results in the misalignment of the folding boards.

As such, a need currently exists for a system and method for more efficiently replacing a set of folding boards with another set of folding boards.

SUMMARY OF THE INVENTION

In accordance with one embodiment of the present invention, a system for selectively replacing a first set of folding boards with a second set of folding boards is disclosed. The system comprises a first carriage assembly capable of being secured to the first set of folding boards. The first carriage assembly is located at a web-receiving position and moveably engages first rails to permit movement from the web-receiving position. The system also comprises a second carriage assembly capable of being secured to the second set of folding boards. The second carriage assembly is located at a first inactive position and moveably engages second rails to permit movement from the web-receiving position.

A transfer apparatus operatively connects the first carriage assembly to the second carriage assembly to permit the selective movement of the first set of folding boards to the first inactive position or a second inactive position and the selective movement of the second set of folding boards from the first inactive position to the web-receiving position. In some embodiments, the transfer apparatus can align the first carriage assembly with the second rails and the second carriage assembly with the first rails. The transfer apparatus may comprise a device configured to raise and lower the first carriage assembly, the second carriage assembly, or combinations thereof. One example of such a device is an elevator.

If desired, the first rails may be secured to a stationary frame configured to support the first carriage assembly while in the web-receiving position. One or more web-folding boards may also be secured to the stationary support frame.

In this manner, the web-folding bars may be used with any set of folding boards without needing to be replaced each time a new set of folding boards is utilized. Also, the first carriage assembly can include a frame connected to mounting arms that moveably engage the first rails, and the second carriage assembly can include a frame connected to mounting arms that moveably engage the second rails.

In accordance with another embodiment of the present invention, a method for selectively replacing one set of folding boards with another set of folding boards in a system for folding webs is disclosed. The method comprises placing a first carriage assembly secured to a first set of folding boards in a web-receiving position and a second carriage assembly secured to a second set of folding boards in a first inactive position. The first carriage assembly moveably engages first rails and the second carriage assembly moveably engages second rails. The first carriage assembly is moved from the web-receiving position through the first rails, and the first rails and second rails are aligned. The second carriage assembly is moved to the web-receiving position through the second rails so that the second carriage assembly moveably engages the first rails when in the web-receiving position.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
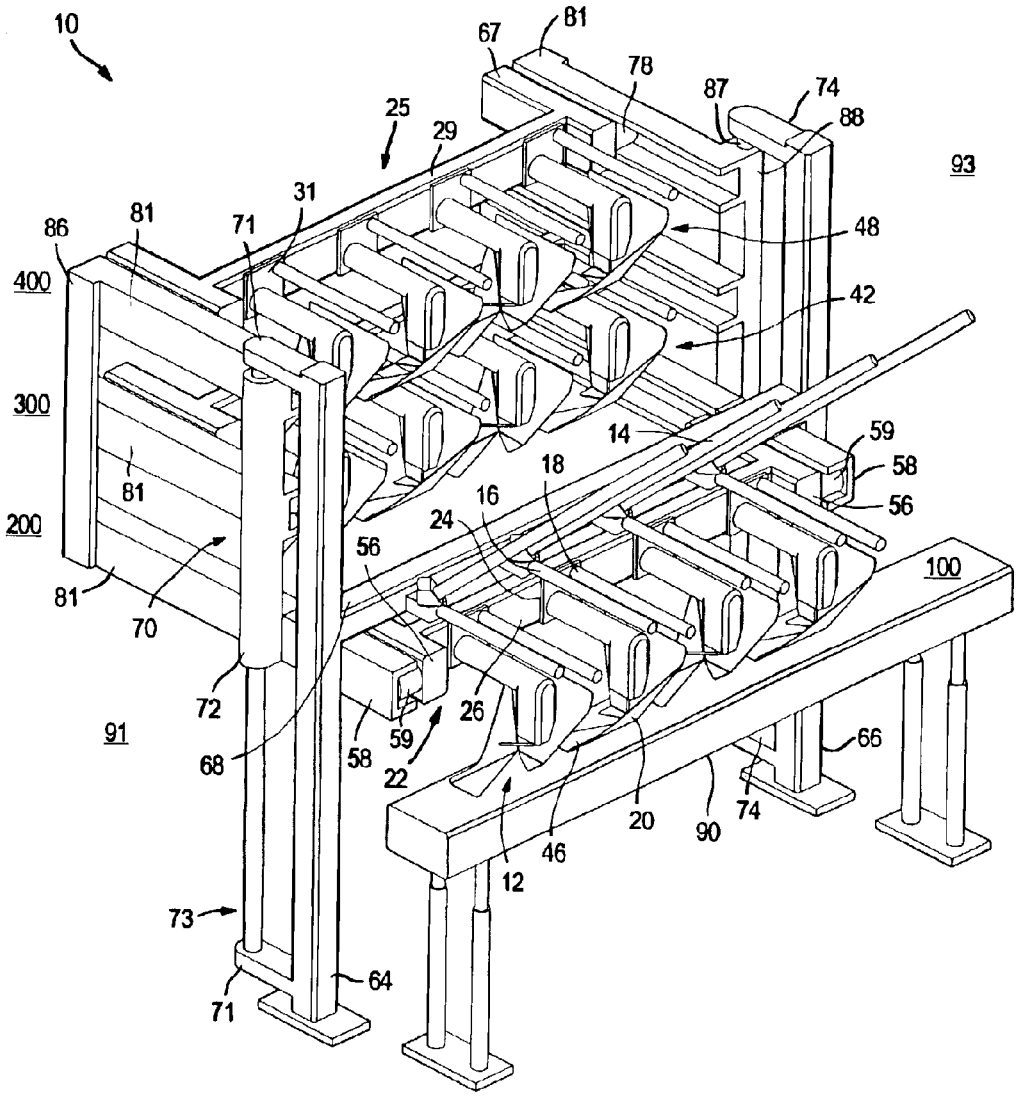
FIG. 1 is a perspective view of one embodiment of a system of the present invention.

Repeat use of reference characters in the present specification and drawings is intended to represent same or analogous features or elements of the present invention.

DETAILED DESCRIPTION OF REPRESENTATIVE EMBODIMENTS

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention covers such modifications and variations as come within the scope of the appended claims and their equivalents.

In general, the present invention is directed to a system and method for selectively replacing one set of folding boards with another set of folding boards. In one embodiment, a first set and a second set of folding boards are secured to carriage assemblies that are selectively moveable in and out of a web-receiving position. Through the system and method of the present invention, it has been discovered that a set of folding boards may be quickly and efficiently replaced with another set of folding boards.

Referring to FIG. 1, for example, one embodiment of a system 10 is shown that is capable of selectively replacing one set of folding boards for another set of folding boards. As used herein, a "set" of folding boards generally includes one or more folding boards. For example, as shown in FIG. 1, a first set 12 can contain four folding boards 20. Any conventional folding board may be utilized in the present invention to impart any type of fold to one or more webs. Specifically, any device, assembly, or mechanism that is capable of imparting one or more folds to one or more webs can be utilized as a folding board in the present invention. For example, some suitable folding boards are described in U.S. Pat. No. 3,401,927 to Frick; U.S. Pat. No. 4,052,048 to Shirasaka; U.S. Pat. No. 4,502,675 to Clark, et al.; U.S. Pat. No. 5,868,276 to Loppnow, et al.; U.S. Pat. No. 5,992,682 to Loppnow, et al.; and U.S. Pat. No. 6,238,328 to Loppnow, et al., which are incorporated herein in their entirety by reference thereto for all purposes. For example, the folding boards may be configured to impart an interfolded configuration, V-fold configuration, a C-fold configuration, etc., to the web. However, it should also be understood that any other type of fold configuration can be imparted by the folding boards. Moreover, it should also be understood that the fold configurations imparted by the folding boards may be the same or different.

As shown, the first set 12 of folding boards is initially provided in a web-receiving position 100. At the web-receiving position 100, the folding boards of the first set 12 are capable of receiving one or more webs, such as tissue webs, which can be provided by an unwinding roll (not shown). For example, two continuous webs can be provided by an unwinding roll (not shown) to be folded by the folding boards 20. Various web-folding bars, such as guide bars 14 and rotating idler bars 16, are mounted to a horizontal support frame 68 connected at each end to vertical support frames 64 and 66. In this embodiment, additional idler bars 18 are attached to a mounting member 24 for the folding boards and thus is moveable therewith. Nevertheless, because at least a portion of the web-folding bars are mounted to the stationary support frame 68, they may used with any set of folding boards without needing to be replaced each time a new set of folding boards is utilized. In the illustrated embodiment, a web is fed successively over turning bar 14, idler bar 16, idler bar 18, and then threaded through the folding board 20 and deposited on a conveyor 90. Other configurations may include two webs per board, with a pair of 45° turning bars. After being folded, the web(s) can then be stacked and cut for packaging. For example, in one embodiment, the conveyor 90 can transport the folded webs to another location. A lift mechanism (not shown) can raise and/or lower the conveyor 90 so that it is capable of being placed into communication with a web passing through the folding boards.

A second set 42 and third set 48 of folding boards are also provided in inactive positions 300 and 400, respectively, while an inactive position 200 is left unoccupied. In addition, other sets of folding boards may also be utilized. For example, referring to FIG. 4, sets 42, 48, 92, 94, and 96 of folding boards are provided in inactive positions 200, 400, 500, 600, and 700, respectively. When located in an inactive position, the folding boards are typically not used to fold webs. However, other types of operations may occur at the inactive position, such as cleaning, sanitizing, maintenance, etc.

Figure 2:
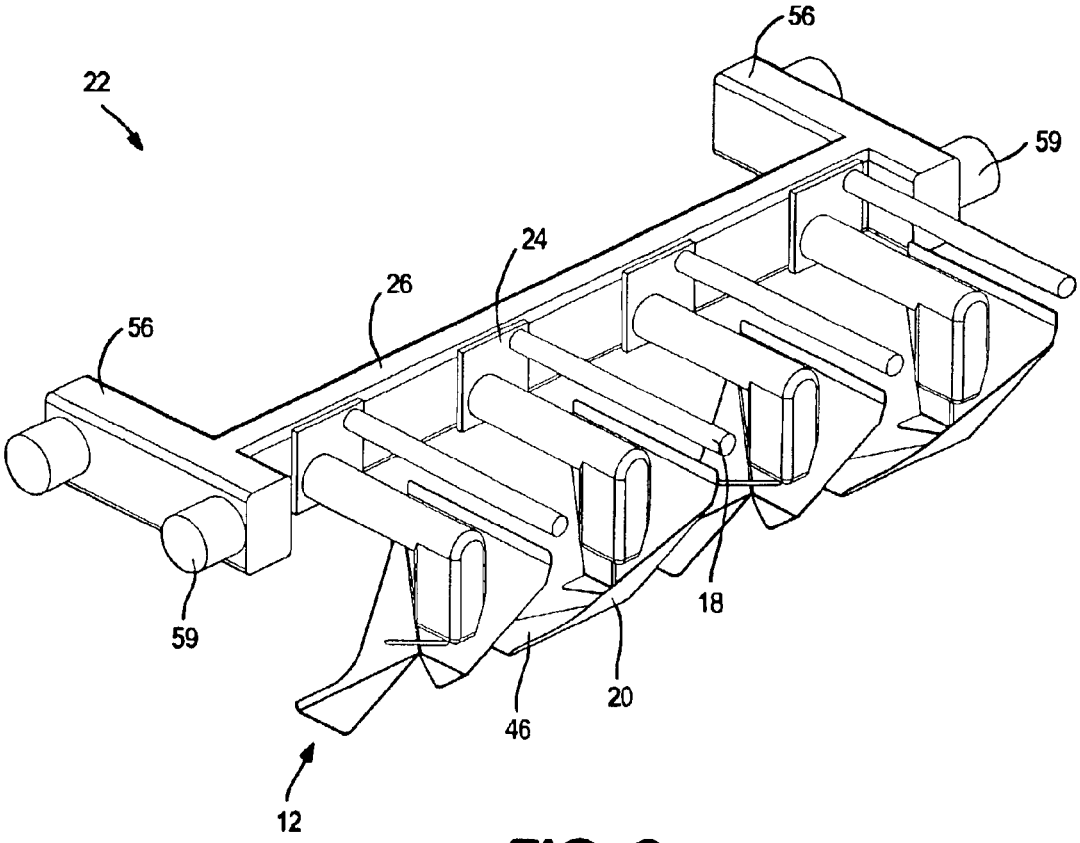
FIG. 2 is a perspective view of the carriage assembly of the system of FIG. 1.

Referring to FIGS. 1–2, the folding boards of the first set 12 are each mounted on a carriage assembly 22. The carriage assembly 22 includes a frame 26 that is secured to the folding boards via a mounting member 24. The frame 26 may be continuous, such as shown in FIG. 1, or discontinuous. In the illustrated embodiment, the carriage assembly 22 also includes mounting arms 56 that are connected to the frame 26 and that moveably engage parallel rails 58 via respective wheels 59, or some other suitable device that allows the desired movement, such as bearings, sliders, etc. The wheels 59 engage the rails 58 so that, when force is applied, the wheels 59 move along the surface of the rails 58, causing the entire carriage assembly 22 to move horizontally. The rails 58 are secured to the support frames 64 and 66 so that the rails 58 can remain stationary.

The system 10 also includes two additional carriage assemblies 25 that are secured to the sets 42 and 48 of folding boards. The carriage assemblies 25 each include a frame 29 that is secured to the folding boards via a mounting member 31. The system 10 also includes rails 81 that moveably engage mounting arms 67 of the carriage assemblies 25 via respective wheels 78 (only one of which is shown in FIG. 1). The rails 81 are interconnected via a frame 86 so that the rails 81 remain stationary relative to each other.

To replace one set of folding boards with another set, the system of the present invention further includes a transfer apparatus that is capable of moving entire sets of folding boards. For example, the transfer apparatus may include a device configured to raise and lower the carriage assemblies into various desired alignments. In this particular embodiment, the device includes an elevator 70 having a linear bearing housing 72 and a guide shaft 73 rigidly fixed to the support platform 64 via brackets 71. The elevator 70 may be actuated by hydraulic, pneumatic, and/or electrical means. During operation, the housing 72 is movable, while the guide shaft 73 remains stationary. The housing 72 is also secured to the three rails 81 at an end 91 of the system 10. At an end 93 of the system 10, a frame 88 is provided that is moveable along a guide shaft 87. The frame 88 is secured to the rails 81 and the shaft 87 is secured to the support platform 66 via brackets 74. If desired, an additional elevator may be also used at the end 93 as described above. Regardless, when the elevator 70 imparts vertical movement as described above, the rails 81 at the end 91 are moved simultaneously. In addition, the frame 88 at the end 93 is also moved simultaneously in the same direction. In this manner, an entire set of folding boards can be easily moved vertically in and out of a position.

Figure 3A:
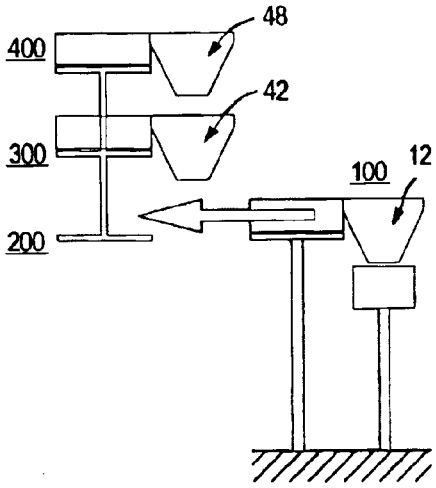
FIGS. 3*a*–3*d* illustrate one embodiment of the sequential steps that may be used to replace a set of folding boards with the system of FIG. 1.
Figure 3B:
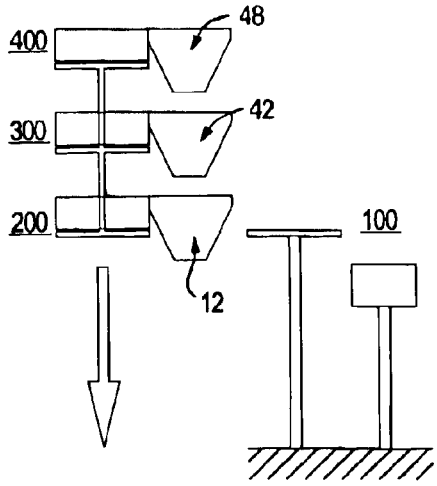
Figure 3C:
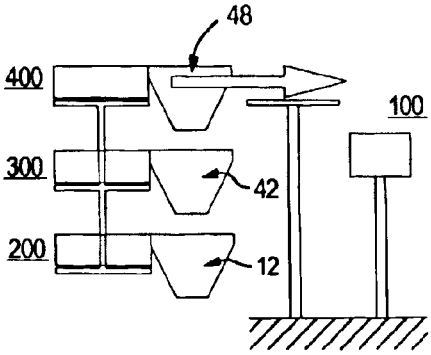
Figure 3D:
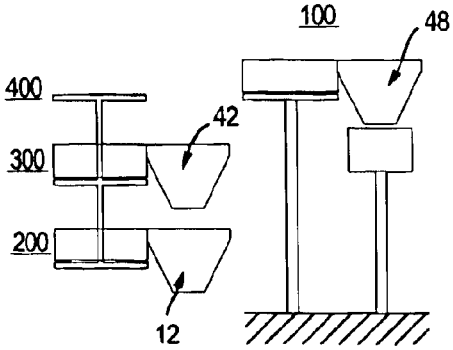

Referring to FIGS. 3*a*–3*d*, one method for selectively replacing one set of folding boards with another set of folding boards using the system described in FIG. 1 will now be described in more detail. As shown in FIG. 3*a*, the first set 12 of folding boards is initially placed in the web-receiving position 100, while the second and third sets 42 and 48 are placed in inactive positions 300 and 400, respectively. The first set 12 is then moved horizontally from the web-receiving position 100 to the inactive position 200, which also acts as a transfer position (FIG. 3*b*). Thereafter, the elevator frame moves the folding boards vertically until the third set of folding boards 48 is aligned with the rails 58 (FIG. 1). Once aligned, the third set 48 is then moved horizontally (FIG. 3*c*) from the inactive position 400, which now acts as a transfer position, to the web-receiving position 100 (FIG. 3*d*).

Figure 4:
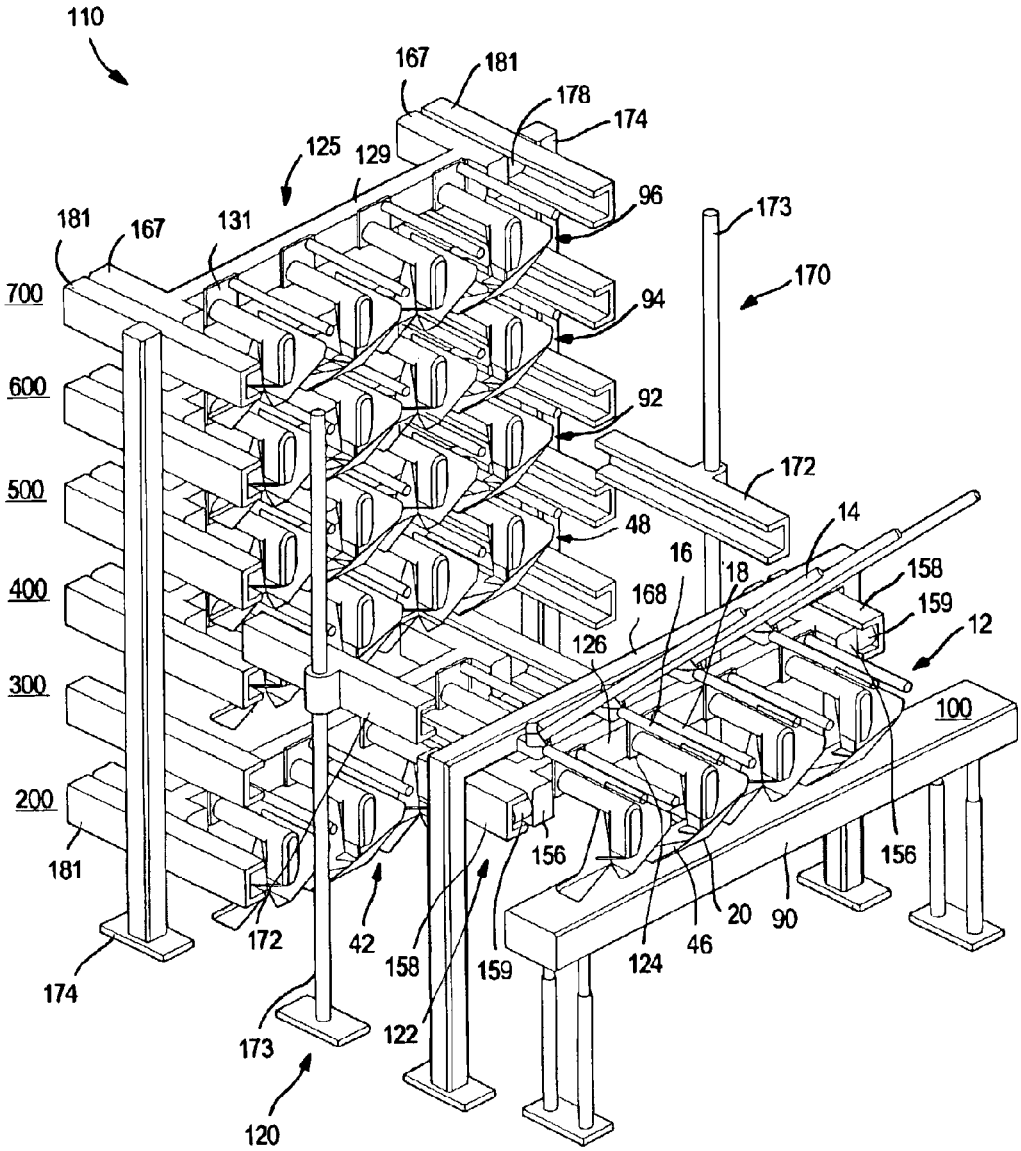
FIG. 4 is a perspective view of another embodiment of a system of the present invention.

Other embodiments are also contemplated in the present invention. For instance, referring to FIG. 4, another embodiment of the system of the present invention is illustrated. As shown, the system 110 includes various web-folding bars, such as guide bars 14 and idler bars 16 and 18. The system 110 also includes a carriage assembly 122 having a frame 126 that is secured to the folding boards 20 via a mounting member 124. In the illustrated embodiment, the carriage assembly 122 also includes mounting arms 156 that are connected to the frame 126 and that moveably engage parallel rails 158 via respective wheels 159. The wheels 159 engage the rails 158 so that, when force is applied, the wheels 159 can move along the surface of the rails 158, causing the entire carriage assembly 122 to move horizontally. The rails 158 are secured to a support frame 168 so that the rails 158 can remain stationary relative to the carriage assembly 122. The system 110 also includes additional carriage assemblies 125 that each include a frame 129 that is secured to the sets 42, 48, 92, 94, and 96 of folding boards via a mounting member 131. In addition, the system 110 includes rails 181 that moveably engage mounting arms 167 of the carriage assemblies 125 via respective wheels 178 (only one of which is shown in FIG. 4). The rails 181 are interconnected via support platforms 174 so that they remain stationary.

To replace one set of folding boards with another set, the system 110 includes a transfer apparatus that utilizes a device configured to raise and lower the carriage assemblies into various desired alignments. In this particular embodiment, the device includes two elevators 170 having rods 173 that are moveable in a vertical direction. Rails 172 are secured to the moveable rods 173 so that the rails 172 can be aligned with the rails 158 at the web receiving position 100, as well as with the rails 181 at the inactive positions 200, 300, 400, 500, 600, or 700. In this manner, an entire set of folding boards can be easily moved vertically in and out of a position.

Figure 5A:
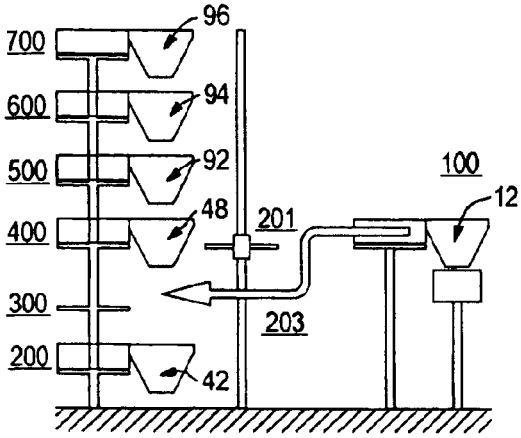
FIGS. 5*a*–5*d* illustrate one embodiment of the sequential steps that may be used to replace a set of folding boards with the system of FIG. 4.
Figure 5B:
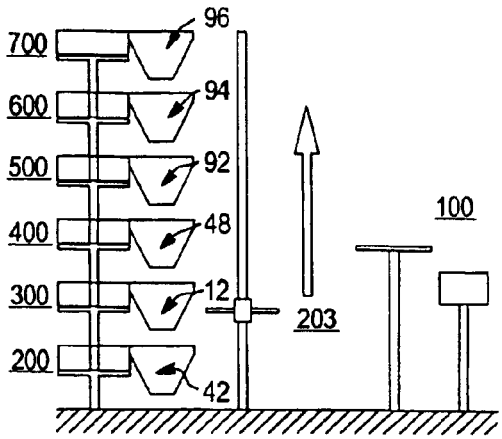
Figure 5C:
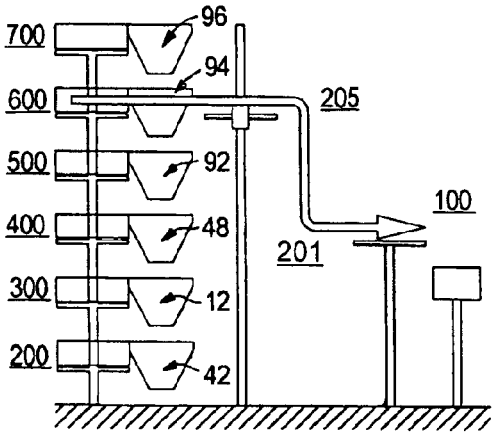
Figure 5D:
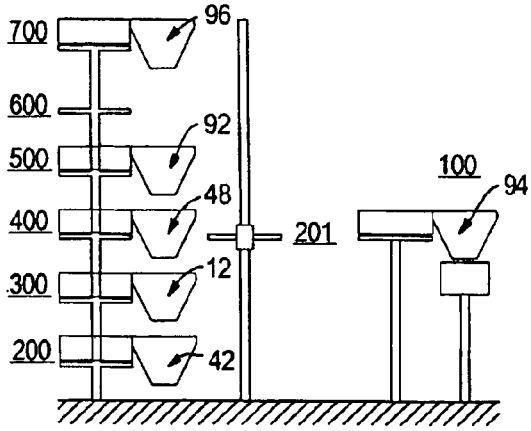

Referring to FIGS. 5*a*–5*d*, one method for selectively replacing one set of folding boards with another set of folding boards using the system described in FIG. 4 will now be described in more detail. As shown in FIG. 5*a*, the first set 12 of folding boards is initially placed in the web-receiving position 100, while sets 42, 48, 92, 94, and 96 are placed in inactive positions 200, 400, 500, 600, and 700, respectively. The first set 12 is then moved horizontally from the web-receiving position 100 to a transfer position 201, moved vertically to a transfer position 203, and then moved horizontally to the inactive position 300. Thereafter, as shown in FIG. 5*b*, the elevators are moved vertically until the set 94 of folding boards is aligned with the rails 172 (FIG. 4). Once aligned, the set 94 is then moved horizontally (FIG. 5*c*) from the inactive position 600 to a transfer position 205, vertically to the transfer position 201, and horizontally to the web-receiving position 100 (FIG. 5*d*).

To facilitate the replacement of a set of folding boards and folding of the web, the system of the present invention may also include a variety of control features. For example, at least one controller may be utilized. The controller can be a programmable logic computer (PLC), such as an Allen-Bradley Controllogix Processor, although any other controller suitable for controlling the system described above, is generally acceptable. Alternately, hard-wired circuitry, relays, software, etc., could be substituted for the PLC and used as the controller. A controller can generally be utilized to monitor and/or adjust one or more of the attributes of system in response to operator input or to one or more sensors, such as photoelectric sensors, that detect a variety of system attributes. In addition, a drive system may also be utilized to controllably actuate the horizontal movement of the folding board sets, such as described above.

Further, well-known locking devices, such as a locking pin, clamps, etc., may be utilized to lock the folding board sets in the desired position. The system may also include a mechanism for removing dust from various parts of the system. For example, dust commonly accumulates within the guide bars and turning bars. Thus, in one embodiment, to remove the dust within these bars, an air supply (not shown) may be used that provides pressurized air into one or more of the guide bars and/or turning bars via a hose or other similar air transport mechanism. In addition, devices may also be utilized to help align a carriage assembly once placed in the web-receiving position.

The method and system of the present invention can generally be utilized to fold one or more webs. The webs may be made of the same type or different types. For example, the webs may be paper webs, such as facial tissue, bath tissue, paper towels, and the like, as well as other types of webs, such as wetwipes, and the like. Further, the webs can also be folded to different widths utilizing a system of the present invention. For instance, in one embodiment, the first set 12 of folding boards can be utilized to form folded tissue webs having a certain width, while a second set 42 of folding boards having a different width can be selectively replaced therefor to form folded tissue webs of different widths. For example, the first set 12 of folding boards can be utilized to fold tissue webs in a C-fold to a width of about 150 millimeters, while the second set 42 of folding boards can be selectively replaced with the first set 12 of folding boards to fold tissue webs in a C-fold to a width of about 110 millimeters.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A system for selectively replacing a first set of folding boards with a second set of folding boards, said system comprising:

a first carriage assembly secured to said first set of folding boards, said first carriage assembly locating said first set of folding boards at a web-receiving position, said first carriage assembly moveably engaging stationary first rails by moving along a surface of said stationary first rails to permit movement of said first set of folding boards from said web-receiving position;

a second carriage assembly secured to said second set of folding boards, said second carriage assembly locating said second set of folding boards at a first inactive position, said second carriage assembly moveably engaging second rails by moving along a surface of said second rails to permit movement of said second set of folding boards from said first inactive position; and a transfer apparatus that permits selective movement of said first set of folding boards to said first inactive position or a second inactive position and selective movement of said second set of folding boards to said web-receiving position.

2. A system as defined in claim 1, wherein said first carriage assembly is moveable in a horizontal direction along a surface of said first rails to displace said first set of folding boards from said web-receiving position.

3. A system as defined in claim 1, wherein said second carriage assembly is moveable in a horizontal direction along a surface of said second rails to displace said second set of folding boards from said first inactive position.

4. A system as defined in claim 1, wherein said first carriage assembly includes a frame connected to mounting arms that moveably engage said first rails, and wherein said second carriage assembly includes a frame connected to mounting arms that moveably engage said second rails.

5. A system as defined in claim 4, wherein said transfer apparatus is capable of aligning said mounting arms of said first carriage assembly with said second rails.

6. A system as defined in claim 4, wherein said transfer apparatus is capable of aligning said mounting arms of said second carriage assembly with said first rails.

7. A system as defined in claim 4, wherein said transfer apparatus comprises a device configured to raise and lower said first carriage assembly, said second carriage assembly, or combinations thereof.

8. A system as defined in claim 7, wherein said device includes an elevator.

9. A system as defined in claim 8, wherein a third rail is secured to said elevator, said elevator being capable of aligning said third rail with said first and said second carriage assemblies.

10. A system as defined in claim 1, further comprising a stationary frame that supports said first carriage assembly while in said web-receiving position.

11. A system as defined in claim 10, wherein one or more web-folding bars are secured to said stationary frame.

12. A system as defined in claim 10, wherein said stationary first rails are secured to said stationary frame.

13. A system for selectively replacing a first set of folding boards with a second set of folding boards, said system comprising:

a first carriage assembly secured to said first set of folding boards, said first carriage assembly locating said first set of folding boards at a web-receiving position, said first carriage assembly moveably engaging stationary first rails by moving along a surface of said stationary first rails to permit movement of said first set of folding boards from said web-receiving position;

a second carriage assembly secured to said second set of folding boards, said second carriage assembly locating said second set of folding boards at a first inactive position, said second carriage assembly moveably engaging second rails by moving along a surface of said second rails to permit movement of said second set of folding boards from said first inactive position;

a stationary frame to which said stationary first rails are secured; and a transfer apparatus capable of aligning said first carriage assembly with said second rails and said second carriage assembly with said first rails to permit selective movement of said first set of folding boards to said first inactive position or a second inactive position and selective movement of said second set of folding boards to said web-receiving position.

14. A system as defined in claim 13, wherein one or more web-folding bars are secured to said stationary frame.

15. A system as defined in claim 13, wherein said first carriage assembly is moveable in a horizontal direction along a surface of said first rails to displace said first set of folding boards from said web-receiving position.

16. A system as defined in claim 13, wherein said second carriage assembly is moveable in a horizontal direction through along a surface of said second rails to displace said second set of folding boards from said first inactive position.

17. A system as defined in claim 13, wherein said transfer apparatus comprises a device for moving said first carriage assembly, said second carriage assembly, or combinations thereof, in a vertical direction.

18. A system as defined in claim 17, wherein said device includes an elevator.

19. A system as defined in claim 18, wherein said first carriage assembly includes a frame connected to mounting arms that moveably engage said first rails, and wherein said second carriage assembly includes a frame connected to mounting arms that moveably engage said second rails.

20. A system as defined in claim 19, wherein a third rail is secured to said elevator, said elevator being capable of aligning said third rail with said mounting arms of said first and second carriage assemblies.

21. A method for selectively replacing one set of folding boards with another set of folding boards in a system for folding webs, said method comprising:

placing a first set of folding boards in a web-receiving position and a second set of folding boards in a first inactive position, wherein said first set of folding boards is secured to a first carriage assembly and said second set of folding boards is secured to a second carriage assembly, said first carriage assembly moveably engaging stationary first rails and said second carriage assembly moveably engaging second rails;

moving said first carriage assembly along a surface of said stationary first rails to displace said first set of folding boards from said web-receiving position;

aligning said second rails with said stationary first rails;

moving said second carriage assembly along a surface of said second rails and said stationary first rails to place said second set of folding boards in said web-receiving position.

22. A method as defined in claim 21, wherein said stationary first rails are secured to a stationary frame.

23. A method as defined in claim 22, wherein one or more web-folding bars are secured to said stationary frame.

24. A method as defined in claim 21, wherein said first carriage assembly moves in a horizontal direction to displace said first set of folding boards from said web-receiving position.

25. A method as defined in claim 24, wherein said second carriage assembly moves in a horizontal direction to displace said second set of folding boards from said first inactive position.

* * * * *